US009127844B2

(12) United States Patent
Slobodyanskiy et al.

(10) Patent No.: US 9,127,844 B2
(45) Date of Patent: Sep. 8, 2015

(54) FUEL NOZZLE

(75) Inventors: Ilya Aleksandrovich Slobodyanskiy, Greenville, SC (US); William Francis Carnell, Jr., Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 1072 days.

(21) Appl. No.: 13/196,611

(22) Filed: Aug. 2, 2011

(65) Prior Publication Data

US 2013/0031905 A1 Feb. 7, 2013

(51) Int. Cl.

| | |
|---|---|
| ***F23R 3/14*** | (2006.01) |
| ***B21D 53/00*** | (2006.01) |
| ***F23R 3/26*** | (2006.01) |
| ***F23R 3/36*** | (2006.01) |

(52) U.S. Cl.

CPC ..... *F23R 3/36* (2013.01); *Y10T 29/49323* (2015.01)

(58) Field of Classification Search

CPC ..... F23D 11/107; F23D 17/002; F23D 2900/11101; F23C 7/004; F23C 2900/07001; F23R 3/12; F23R 3/14; F23R 3/28; F23R 3/34; F23R 3/36; F23R 3/286; F23R 3/242; Y02T 50/675; Y10T 29/49323; B05B 1/3405; B05B 1/3421

USPC ..... 60/740, 742, 748, 737

See application file for complete search history.

(56) References Cited

U.S. PATENT DOCUMENTS

| | | | | |
|---|---|---|---|---|
| 5,351,477 | A | 10/1994 | Joshi et al. | |
| 5,966,937 | A | 10/1999 | Graves | |
| 6,547,163 | B1 | 4/2003 | Mansour et al. | |
| 7,703,287 | B2 * | 4/2010 | Haggerty et al. | 60/740 |
| 2010/0077760 | A1 * | 4/2010 | Laster et al. | 60/742 |

* cited by examiner

*Primary Examiner* — Ehud Gartenberg
*Assistant Examiner* — Jared W Pike

(57) ABSTRACT

A fuel nozzle is provided and includes a nozzle body defining first and second interior regions for providing a supply of first and second fluids, a collar defining a third interior region and radial slots permitting radial ingress of a third fluid to the third interior region and a nozzle tip interposed between the nozzle body and the collar. The nozzle tip defines an annular slot, first discrete passageways by which the first fluid is communicated from the first interior region to the annular slot, second discrete passageways by which the first fluid is communicated from the annular slot to the radial slots, and third discrete passageways by which the second fluid is communicated from the second interior region to the radial slots.

20 Claims, 4 Drawing Sheets

FUEL NOZZLE

BACKGROUND OF THE INVENTION

The subject matter disclosed herein relates to a fuel nozzle and, more particularly, to a fuel nozzle with liquid fuel staging and partial mixing.

In gas turbine engines, liquid and gaseous fuels are mixed with air and other combustible materials and injected as a mixture into a combustor where combustion occurs to produce high energy fluids from which power and electricity can be generated. Often, this mixing occurs upstream from the combustion zone of the combustor in, for example, pre-mixing passages. The liquid and gaseous fuels are injected into these pre-mixing passages from internal plenums within fuel nozzles that are often provided in a complex arrangement.

The complex arrangement of the plenums within fuel nozzles require that the liquid and gaseous fuels follow complicated routes from the internal plenums to the pre-mixing passages and do not allow for certain types of liquid fuel staging or additional forms of partial mixing.

BRIEF DESCRIPTION OF THE INVENTION

According to one aspect of the invention, a fuel nozzle is provided and includes a nozzle body defining first and second interior regions for providing a supply of first and second fluids, a collar defining a third interior region and radial slots permitting radial ingress of a third fluid to the third interior region and a nozzle tip interposed between the nozzle body and the collar. The nozzle tip defines an annular slot, first discrete passageways by which the first fluid is communicated from the first interior region to the annular slot, second discrete passageways by which the first fluid is communicated from the annular slot to the radial slots, and third discrete passageways by which the second fluid is communicated from the second interior region to the radial slots.

According to another aspect of the invention, a fuel nozzle is provided and includes a nozzle body defining first and second interior regions for providing a supply of first and second fluids, a collar defining a third interior region and radial slots permitting radial ingress of a third fluid to the third interior region, the collar including swirler vanes disposed in each of the radial slots to impart a swirling effect to the third fluid and a nozzle tip interposed between the nozzle body and the collar. The nozzle tip defines an annular slot, first discrete passageways by which the first fluid is communicated from the first interior region to the annular slot, second discrete passageways extending through corresponding ones of the swirler vanes by which the first fluid is communicated to the radial slots, and third discrete passageways by which the second fluid is communicated from the second interior region to the radial slots.

According to yet another aspect of the invention, a method of assembling a nozzle tip of a fuel nozzle for interposition between a nozzle body defining first and second interior regions for providing a supply of first and second fluids and a collar defining a third interior region and radial slots permitting radial ingress of a third fluid to the third interior region is provided. The method includes forming an annular slot within the nozzle tip, machining first discrete passageways into the nozzle tip such that the first fluid is able to be communicated from the first interior region to the annular slot, machining second discrete passageways into the nozzle tip such that the first fluid able to be communicated from the annular slot to the radial slots and machining third discrete passageways into the nozzle tip such that the second fluid is able to be communicated from the second interior region to the radial slots.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
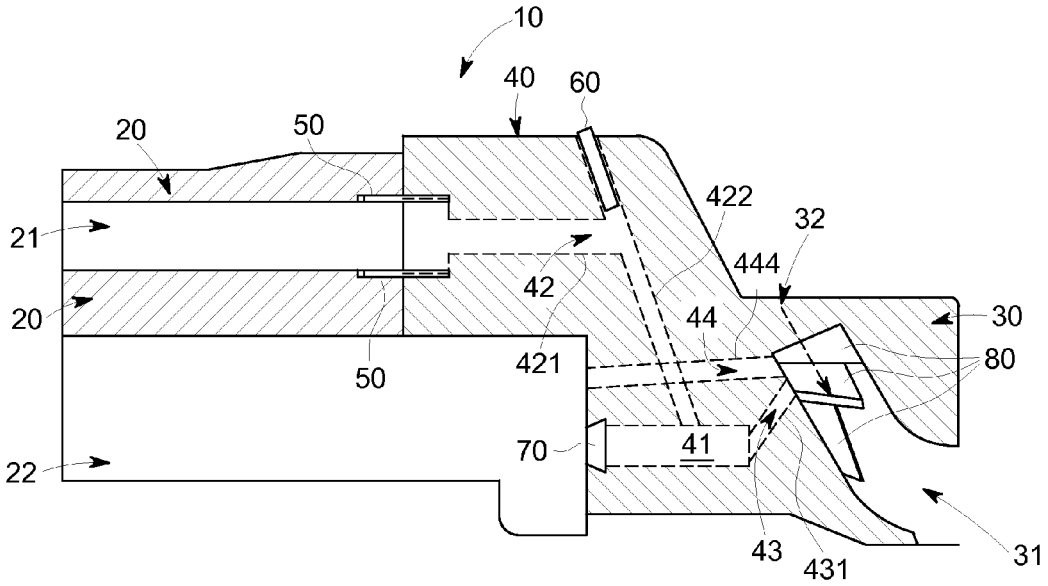
FIG. 1 is a radial view of a fuel nozzle.
Figure 2:
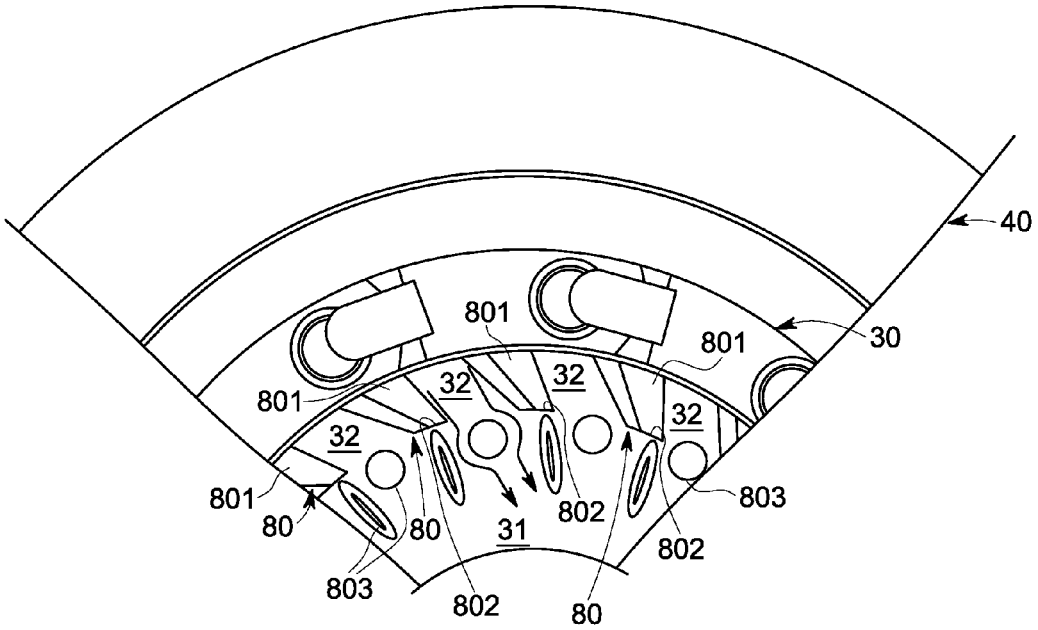
FIG. 2 is an axial view of the fuel nozzle of FIG. 1.

With reference to FIGS. 1 and 2, a fuel nozzle 10 is provided and provides for liquid fuel staging and partial mixing of liquid fuel, gas and air. The fuel nozzle 10 includes a nozzle body 20, a collar 30 and a nozzle tip 40. The nozzle body 20 is formed to define a first interior region 21, which may be a discrete hole or multiple discrete holes arranged annularly, for providing a supply of a first fluid for, for example, combustion operations of a gas turbine engine operating in a first mode. The nozzle body 20 is further formed to define a second interior region 22 for providing a supply of a second fluid for when the exemplary gas turbine engine is operated in a second mode. The collar 30 is formed to define a third interior region 31 and radial slots 32. The radial slots 32 permit radial ingress of a third fluid to the third interior region 31 during most operational modes of the exemplary gas turbine engine.

In accordance with embodiments, the first fluid may include liquid fuel, the second fluid may include gas, such as natural gas, propane, etc., and the third fluid may include air, such as compressor discharge air provided from a compressor of the exemplary gas turbine engine. It is to be understood however, that other fluids may be provided by or to the first, second and third interior regions 21, 22, 31 in accordance with various applications of the description provided herein. In accordance with an aspect, the first fluid, such as the liquid fuel, may also be provided to the interior region 31 from a center body liquid fuel supply section of the nozzle body 20 via a central injector during start up operations and/or other low flow conditions.

The nozzle tip 40 is operably interposed between the nozzle body 20 and the collar 30. In particular, the nozzle tip 40 may be an annular body and may be affixed to an aft end of the nozzle body 20 and welded or brazed to a forward end of the collar 30. The nozzle tip 40 is formed to define an annular slot 41, first discrete passageways 42, second discrete passageways 43 and third discrete passageways 44. The annular slot 41 is formed as an annular slot within the annular body of the nozzle tip 40 whereas the first and second discrete passageways 42, 43 are formed as circumferentially discrete passageways through the annular body of the nozzle tip 40. A number and respective positions of the first and second discrete passageways 42, 43 may correspond with each other and with the radial slots 32 of the collar 30. That is, for each radial slot 32 defined within the collar 30, a first discrete passageway 42 and a second discrete passageway 43 may be defined through the nozzle tip 40.

In accordance with embodiments, the first discrete passageways 42 extend axially from the first interior region 21 along first sections 421 and radially from the first sections 421 to the annular slot 41 along second sections 422. The second sections 422 may be oriented with only radial components or at an angle with radial and axial components. In either case, the first fluid may be communicated from the first interior region 21 to the annular slot 41 via the first sections 421 and the second sections 422. The second discrete passageways 43 extend axially and radially from the annular slot 41 to a location just downstream from the radial slots 32 along main sections 431. As such, the first fluid may be communicated from the annular slot 41 to the location just downstream from the radial slots 32 and into the third interior region 31. The third discrete passageways 44 extend axially and radially from the second interior region 22 to a location just downstream from the radial slots 32 along axial sections 444. As such, the second fluid may be communicated from the second interior region 22 to the location just downstream from the radial slots 32 and into the third interior region 31.

In accordance with an aspect, the fuel nozzle 10 may further include deformable seals 50. The deformable seals 50 are formed of compliant material and may be disposed at interfaces between the first interior region 21 and each of the first discrete passageways 42. The deformable seals 50 therefore account for at least axial, radial and/or circumferential differential thermal growth between the nozzle body 20 and the nozzle tip 40 such that leakage of the first fluid is prevented.

In the assembly of the fuel nozzle 10, the nozzle tip 40 is formed by, for example, casting, machining, forging or another similar process or processes. The annular slot 41 may be formed by similar process or processes. The first, second and third passageways 42, 43, 44, however, can be machined into the nozzle tip 40. Generally, such machining is performed along substantially straight lines with the result being that at least the second sections 422 will extend from an exterior surface of the nozzle tip 40, past the first sections 421 and into the annular slot 41. First plugs 60 may, therefore, be provided in the second sections 422 to prevent leakage of the first fluid from the first discrete passageways 42 to an exterior of the nozzle tip 40. In addition, since the annular slot 41 can be open to the second interior region 22, a second plug 70 may be provided to prevent leakage of the first fluid from the annular slot 41 to the second interior region 22 and to prevent leakage of the second fluid from the second interior regions 22 to the annular slot 41. A periphery of the second plug 70 may be welded or otherwise sealed to the nozzle tip 40 such that any leakage across the second plug in either direction is prevented.

Still referring to FIGS. 1 and 2, swirler vanes 80 may be disposed in corresponding ones of each of the radial slots 32 to impart a swirling effect to the ingression of the third fluid toward the third interior region 31. As shown in FIG. 2, each swirler vane 80 has a blade body 801, which is angled relative to a radial dimension of the fuel nozzle 10, and a surface 802 that faces the third interior 31. Respective outlets 803 of the second and third discrete passageways 43, 44 are defined proximate to the swirler vanes 80 in the corresponding ones of the radial slots 32. Each respective outlet 803 may have one or more of an elliptical, a circular and/or a teardrop shape. With this construction, as the first fluid exits the second discrete passageways, the first fluid may flow along the surface 802 thereby forming a film from which the first fluid is atomized by the third fluid flowing through the radial slots 32 and by the second fluid flowing through the third passageways 44.

Figure 3:
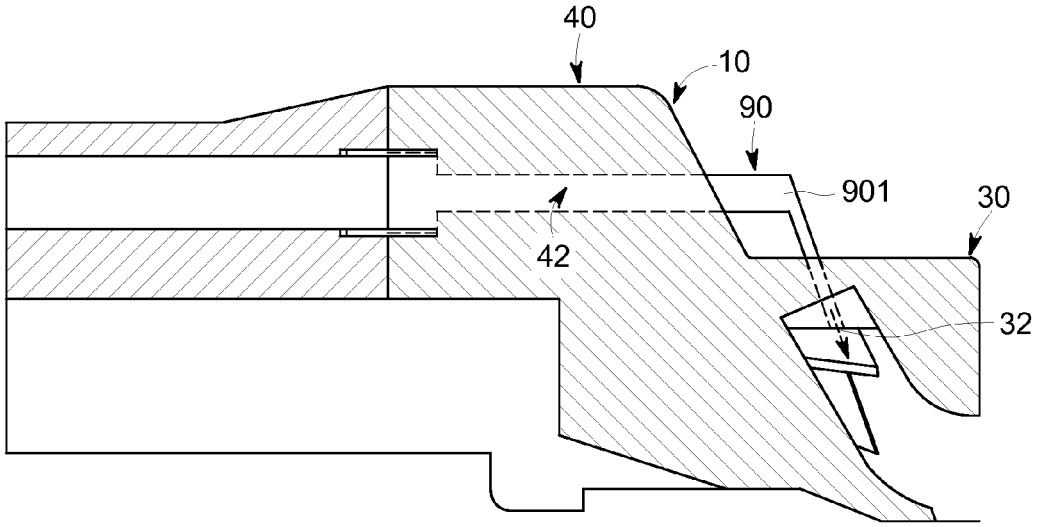
FIG. 3 is a radial view of a fuel nozzle in accordance with further embodiments.
Figure 4:
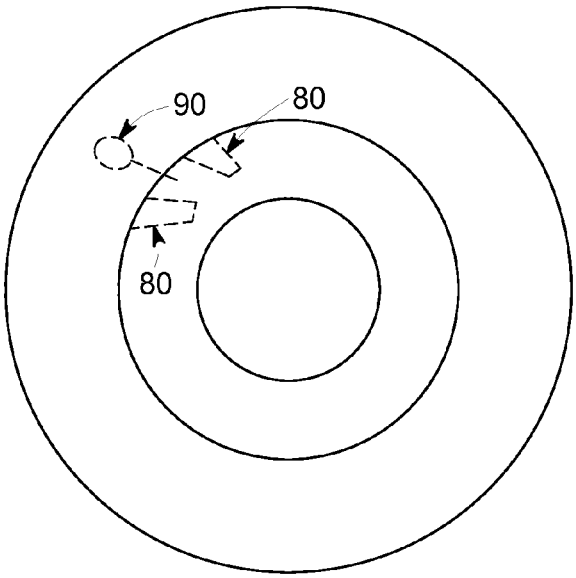
FIG. 4 is an axial view of the fuel nozzle of FIG. 3.

With reference to FIGS. 3 and 4, in accordance with further embodiments, the fuel nozzle 10 may further include injectors 90 disposed about the nozzle tip 40 and the collar 30. The injectors 90 are formed to define respective interiors 901 and are configured to inject the first fluid into the radial slots 32 from the respective interiors thereof. As shown in FIG. 3, the nozzle tip 40 may be further formed to define extensions of the first discrete passageways 42 by which the first fluid is communicated from the first discrete passageways 42 to the respective interiors 901 of the injectors 90. As shown in FIG. 4, where the swirler vanes 80 are disposed in each of the radial slots 32, in accordance with embodiments, the injectors 90 may be positioned circumferentially between adjacent swirler vanes 80. With this construction, as the first fluid exits the injectors 90, the first fluid may be atomized by the third fluid flowing through the radial slots 32.

Figure 5:
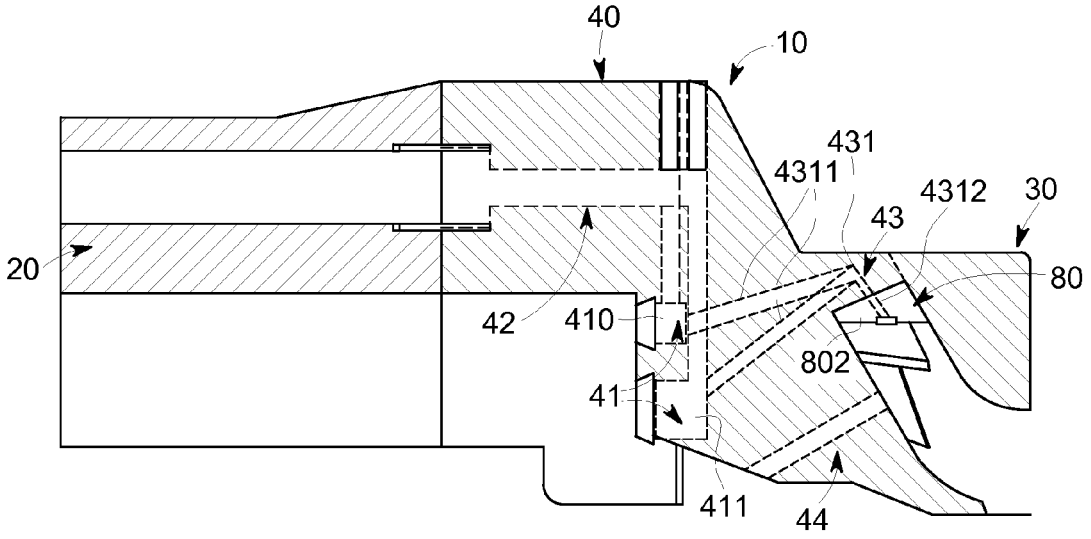
FIG. 5 is a radial view a fuel nozzle in accordance with further embodiments.

With reference to FIG. 5 and, in accordance with further embodiments, the fuel nozzle 10 may include the nozzle body 20, the collar 30 and the swirler vanes 80 as substantially described above but with the second discrete passageways 43 extending through corresponding ones of the swirler vanes 80. In these embodiments, the main sections 431 of the second discrete passageways 43 may extend radially outwardly through the nozzle tip 40 along first portions 4311 and then radially inwardly through the swirler vanes 80 along second portions 4312. In addition, in these embodiments, the annular slot 41 may include first annular slots 410 and second annular slots 411. The first annular slots 410 are communicative with a first portion of the first discrete passageways 42 and the second annular slots 411 are communicative with a second portion of the first discrete passageways 42. With this construction, the first fluid may flow into the first and/or the second annular slots 410, 411 and then through the first and second portions 4311, 4312 of the second discrete passageways 42. As the first fluid exits the second portions 4312 of the second discrete passageways 42, the first fluid may flow from surface 802 and into third interior region 31 with atomization aided by the third fluid.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A fuel nozzle, comprising:

a nozzle body defining first and second interior regions for providing a supply of first and second fluids;

a collar defining a third interior region and radial slots permitting radial ingress of a third fluid to the third interior region; and a nozzle tip interposed between the nozzle body and the collar, the nozzle tip defining:

a annular slot, first discrete passageways that extend axially from the first interior region and then radially to the annular slot by which the first fluid is communicated from the first interior region to and into the annular slot, second discrete passageways by which the first fluid is communicated form the annular slot to and into the radial slots, and third discrete passageways by which the second fluid is communicated from the second interior region to and into the radial slots.

2. The fuel nozzle according to claim 1, wherein the first fluid comprises liquid fuel, the second fluid comprises gas and the third fluid comprises air.

3. The fuel nozzle according to claim 1, further comprising seals disposed between the first interior region and the first discrete passageways.

4. The fuel nozzle according to claim 1, further comprising plugs to prevent leakage from the first discrete passageways to an exterior of the nozzle tip and from the annular slot to the second interior region.

5. The fuel nozzle according to claim 1, further comprising swirler vanes disposed in each of the radial slots to impart a swirling effect to the third fluid.

6. The fuel nozzle according to claim 5, wherein respective outlets of the second and third discrete passageways are defined proximate to the swirler vanes in corresponding ones of the radial slots.

7. The fuel nozzle according to claim 6, wherein each respective outlet has one or more of an elliptical, a circular or a teardrop shape.

8. The fuel nozzle according to claim 1, further comprising injectors disposed about the nozzle tip and the collar to inject the first fluid into the radial slots from respective interiors thereof, the nozzle tip defining extensions of the first discrete passageways by which the first fluid is communicated from the first discrete passageways to the respective interiors of the injectors.

9. A fuel nozzle, comprising:

a nozzle body defining first and second interior regions for providing a supply of first and second fluids;

a collar defining a third interior region and radial slots permitting radial ingress of a third fluid to the third interior region, the collar including swirler vanes disposed in each of the radial slots to impart a swirling effect to the third fluid; and a nozzle tip interposed between the nozzle body and the collar, the nozzle tip defining:

an annular slot, first discrete passageways that extend axially from the first interior region and then radially to the annular slot by which the first fluid is communicated from the first interior region to an into the annular slot, second discrete passageways extending through corresponding ones of the swirler vanes by which the first fluid is communicated to and into the radial slots, and third discrete passageways by which the second fluid is communicated from the second interior region to and into the radial slots.

10. The fuel nozzle according to claim 9, wherein the first fluid comprises liquid fuel, the second fluid comprises gas and the third fluid comprises air.

11. The fuel nozzle according to claim 9, further comprising seals disposed between the first interior region and the first discrete passageways.

12. The fuel nozzle according to claim 9, further comprising plugs to prevent leakage from the first discrete passageways to an exterior of the nozzle tip and from the annular slot to the second interior region.

13. The fuel nozzle according to claim 9, wherein respective outlets of the third discrete passageways are defined proximate to the swirler vanes in corresponding ones of the radial slots.

14. The fuel nozzle according to claim 13, wherein each respective outlet has one or more of an elliptical, a circular or a teardrop shape.

15. The fuel nozzle according to claim 9, wherein the annular slot comprises:

first annular slots communicative with a first portion of the first discrete passageways; and second annular slots communicative with a second portion of the first discrete passageways.

16. The fuel nozzle according to claim 9, further comprising injectors disposed about the nozzle tip and the collar to inject the first fluid into the radial slots between adjacent swirler vanes from respective interiors thereof, the nozzle tip defining extensions of the first discrete passageways by which the first fluid is communicated from the first discrete passageways to the respective interiors of the injectors.

17. A method of assembling a nozzle tip of a fuel nozzle for interposition between a nozzle body defining first and second interior regions for providing a supply of first and second fluids and a collar defining a third interior region and radial slots permitting radial ingress of a third fluid to the third interior region, the method comprising:

forming an annular slot within the nozzle tip;

machining first discrete passageways into the nozzle tip such that the first discrete passageways extend axially form the first interior region an then radially to the annular slot and such that the first fluid is able to be communicated from the first interior region to and into the annular slot;

machining second discrete passageways into the nozzle tip such that the first fluid able to be communicated form the annular slot to and into the radial slots; and machining third discrete passageways into the nozzle tip such that the second fluid is able be communicated from the second interior region to and into the radial slots.

18. The method according to claim 17, further comprising plugging the first discrete passageways.

19. The method according to claim 17, wherein the machining comprises machining of the second and third discrete passageways to have one or more of an elliptical, a circular or a teardrop shape.

20. The method according to claim 17, further comprising disposing injectors about the nozzle tip and the collar to inject the first fluid into the radial slots from respective interiors thereof, the machining comprising machining extensions of the first discrete passageways by which the first fluid is able to be communicated from the first discrete passageways to the respective interiors of the injectors.

* * * * *